US007921821B2

(12) United States Patent
Rörig et al.

(10) Patent No.: US 7,921,821 B2
(45) Date of Patent: Apr. 12, 2011

(54) SWITCHABLE FINGER LEVER OF A VALVE TRAIN OF AN INTERNAL COMBUSTION ENGINE

(75) Inventors: Bodo Rörig, Weisendorf (DE); Joachim Seitz, Reundorf (DE)

(73) Assignee: Schaeffler KG, Herzogenaurach (DE)

( * ) Notice: Subject to any disclaimer, the term of this patent is extended or adjusted under 35 U.S.C. 154(b) by 266 days.

(21) Appl. No.: 12/214,337

(22) Filed: Jun. 18, 2008

(65) Prior Publication Data

US 2009/0000584 A1 Jan. 1, 2009

(30) Foreign Application Priority Data

Jun. 26, 2007 (DE) ..... 10 2007 029465

(51) Int. Cl.
*F01L 1/18* (2006.01)

(52) U.S. Cl. ..... 123/90.44; 123/90.39

(58) Field of Classification Search ..... 123/90.39, 123/90.44, 90.27, 90.16, 90.45
See application file for complete search history.

(56) References Cited

U.S. PATENT DOCUMENTS 5,544,626 A * 8/1996 Diggs et al. ..... 123/90.16
6,314,928 B1 * 11/2001 Baraszu et al. ..... 123/90.16
6,532,920 B1 * 3/2003 Sweetnam et al. ..... 123/90.16
6,769,387 B2 * 8/2004 Hayman et al. ..... 123/90.39
6,925,978 B1 * 8/2005 Gerzseny et al. ..... 123/90.39
6,976,461 B2 * 12/2005 Rorig et al. ..... 123/90.16
7,484,487 B2 * 2/2009 Zurface et al. ..... 123/90.39
2005/0247279 A1 * 11/2005 Rorig et al. ..... 123/90.16
2007/0000460 A1 * 1/2007 Roerig et al. ..... 123/90.16
2007/0006837 A1 * 1/2007 Seitz et al. ..... 123/90.39
2007/0101958 A1 * 5/2007 Seitz ..... 123/90.16
2009/0031975 A1 * 2/2009 Rorig ..... 123/90.39

* cited by examiner

*Primary Examiner* — Thomas E Denion
*Assistant Examiner* — Daniel A Bernstein
(74) *Attorney, Agent, or Firm* — Charles A. Muserlian

(57) ABSTRACT

A switchable finger lever (1) of a valve train of an internal combustion engine, said finger lever (1) comprising an outer lever (2) between whose arms (3) an inner lever (4) extends, a support (9) for at least one gas exchange valve being arranged on one end (7), said inner and outer levers (4, 2) extending on a common axle (10) in the region of said one end (7), said finger lever (1) further comprising a lost motion spring means (11) acting between said inner and outer levers (4, 2), said outer lever (2) possessing on the undersurface (8) on another end (12), a contact surface (13) for a support element, a coupling element (14) is arranged above or laterally of said contact surface (13), which coupling element (14), for realizing coupling, can be brought partially into engagement with an entraining surface (15) of an adjoining crossbar (16) of the inner lever (4), wherein the inner lever (4), starting from its crossbar (16) on the another end (12), merges into a box-like open center portion (17) having two bar-shaped arms (18).

9 Claims, 2 Drawing Sheets

SWITCHABLE FINGER LEVER OF A VALVE TRAIN OF AN INTERNAL COMBUSTION ENGINE

FIELD OF THE INVENTION

The invention concerns a switchable finger lever of a valve train of an internal combustion engine, said finger lever comprising an outer lever between whose arms an inner lever extends for pivoting relative to said arms, at least said inner lever possessing on an upper side, a cam contacting surface, a support for at least one gas exchange valve being arranged on an undersurface on one end of the finger lever, said inner and outer levers extending on a common axle in a region of said one end, said finger lever further comprising a lost motion spring means acting between said inner and outer levers, said outer lever possessing on the undersurface on another end, a contact surface for a support element, a longitudinally displaceable coupling element being arranged above- or laterally of said contact surface, which coupling element, for realizing coupling, can be brought partially into engagement with an entraining surface of an adjoining crossbar of the inner lever.

BACKGROUND OF THE INVENTION

Finger levers of the pre-cited type configured as lift switches or lift deactivators are sufficiently well-known in the technical field. Depending on the particular case, these have a higher mass and a larger design width/height than non-switchable finger levers. A particularly detrimental influence is exerted by the higher mass on the side of the valve distant from the fulcrum due to a heightened mass moment of inertia.

OBJECTS OF THE INVENTION

It is an object of the invention to provide a switchable finger lever of the pre-cited type that has a lighter design weight, particularly on the side of the valve.

This and other objects and advantages of the invention will become more obvious from the following detailed description.

SUMMARY OF THE INVENTION

The invention achieves the above objects by the fact that the inner lever, starting from said crossbar on the another end, merges into a box-like open center portion having two bar-shaped arms that, in a direction toward the one end, comprise crossbar sections that are strongly bent toward each other and extend further in form of a common, thin-walled bar comprising an eye that surrounds the axle in a central region of the axle, the outer lever comprises a box-like open center portion comprising said arms of the outer lever between which the center portion of the inner lever extends and that are likewise bar-shaped, these bar-shaped arms of the outer lever extend further in direction of the one end in form of transversal sections that are strongly bent toward each other and end in two parallel fingers while being arranged through bores on the axle, and the outer lever, at least starting from said arms in the center portion of the outer lever up to the fingers on the one end, adjoins the inner lever in a wall-against-wall engagement.

Due to the fact that the arms of the outer and the inner lever are bent strongly towards the central longitudinal plane of the finger lever, the design space required by the finger lever in the one end region (valve side) is relatively narrow so that its mass in this region is also reduced. In the final analysis, the inner lever comprises only one arm on this side. A feature of the invention to be particularly emphasized here is that, from the center region up to the one end, the outer lever is substantially in wall-against-wall engagement with the inner lever, so that the support for the valve stem can be configured with a very narrow design width.

The transversal sections of the outer lever and the crossbar sections of the inner lever can extend almost or fully perpendicular to the central longitudinal axis. Due to the osculating arrangement of the inner and outer levers relative to each other, at least in the region from the center portion up to the one end, the inner "dead space" otherwise encountered in the prior art is substantially eliminated. As seen in a top view, the outer lever thus has a quasi box-like geometry in whose recess the inner lever extends.

According to a further provision of the invention, the coupling element is arranged in the region of the other end of the outer lever. Appropriately, this coupling element is configured as a longitudinally displaceable piston or group of pistons which can be displaced in one direction of displacement by hydraulic medium pressure that can be routed from the contact surface. If the coupling element is arranged inclined downwards in coupling direction, the design height of the finger lever can also be additionally reduced. Imaginable and included in the invention in this regard are also transversely extending or slanting coupling elements.

According to one advantageous development of the invention, the end piece comprising the reception for the coupling element may be configured in one piece with the outer lever or be made as a-separate insert element.

It is further advantageous, if the bar at the one end of the inner lever is prolonged beyond the axle into a lug-like extension. This extension may optionally be made in one piece with the bar and serves as a one-end support surface for one leg of a lost motion spring. This latter is advantageously, but not exclusively, configured as a torsion leg spring.

According to another proposition of the invention, for a simple mounting of said torsion leg spring, the axle on the one end projects with a stub beyond the fingers of the outer lever on each side of the outer lever, so that a portion of the winding of the torsion leg spring can be mounted on each stub.

Advantageously, each stub is surrounded with clearance by a bushing whose outer peripheral surface is directly surrounded by winding regions of the lost motion spring means. These bushings serve, for example, to reduce wear in the region of the stubs.

It is obvious that two separate torsion leg springs may also be used, in which case their outer legs are not connected to each other. Where appropriate, it is also possible to use an assembly of torsion leg springs on each side or only one torsion leg spring on one of the stubs.

The last-mentioned torsion leg spring enables a relatively compact overall structure of the finger lever and is easy mount.

If the finger lever is configured as a lift deactivator, only the inner lever comprises a cam contacting surface. This can be constituted by a rolling bearing-mounted roller or by a sliding surface. In place of the rolling bearing-mounting of the roller, a sliding bearing-mounting of the roller is also possible.

Sliding surfaces or rollers as cam contacting surfaces are likewise imaginable and included in the invention also in the case of the switchable finger lever being configured as a lift switch.

The proposed perforations of the arms of the outer lever can serve to further reduce its mass. But the particular reason for providing the perforations is to enable mounting and dismounting of the pin for the roller. Dismounting can become necessary, for instance, if, after pre-assembly of the roller with the pin, a mounting lash (coupling lash, base circle lash) is compared to a desired value and a selective matching has to be undertaken with off-the-shelf rollers that are classified according to their diameters.

According to a further development of the invention, the support for the gas exchange valve on the one end is configured on a crossbar that connects, in a simple manner, the fingers of the outer lever to each other on the undersurface. Due to the small spacing between the fingers, this crossbar has only a small width which has a favorable effect on the sag behavior of the crossbar. If necessary, this support may also extend on the inner lever.

BRIEF DESCRIPTION OF THE DRAWING

The invention is explained below in more detail with reference to the drawing. The figures of the drawing show.

DETAILED DESCRIPTION OF THE DRAWING

Figure 1:
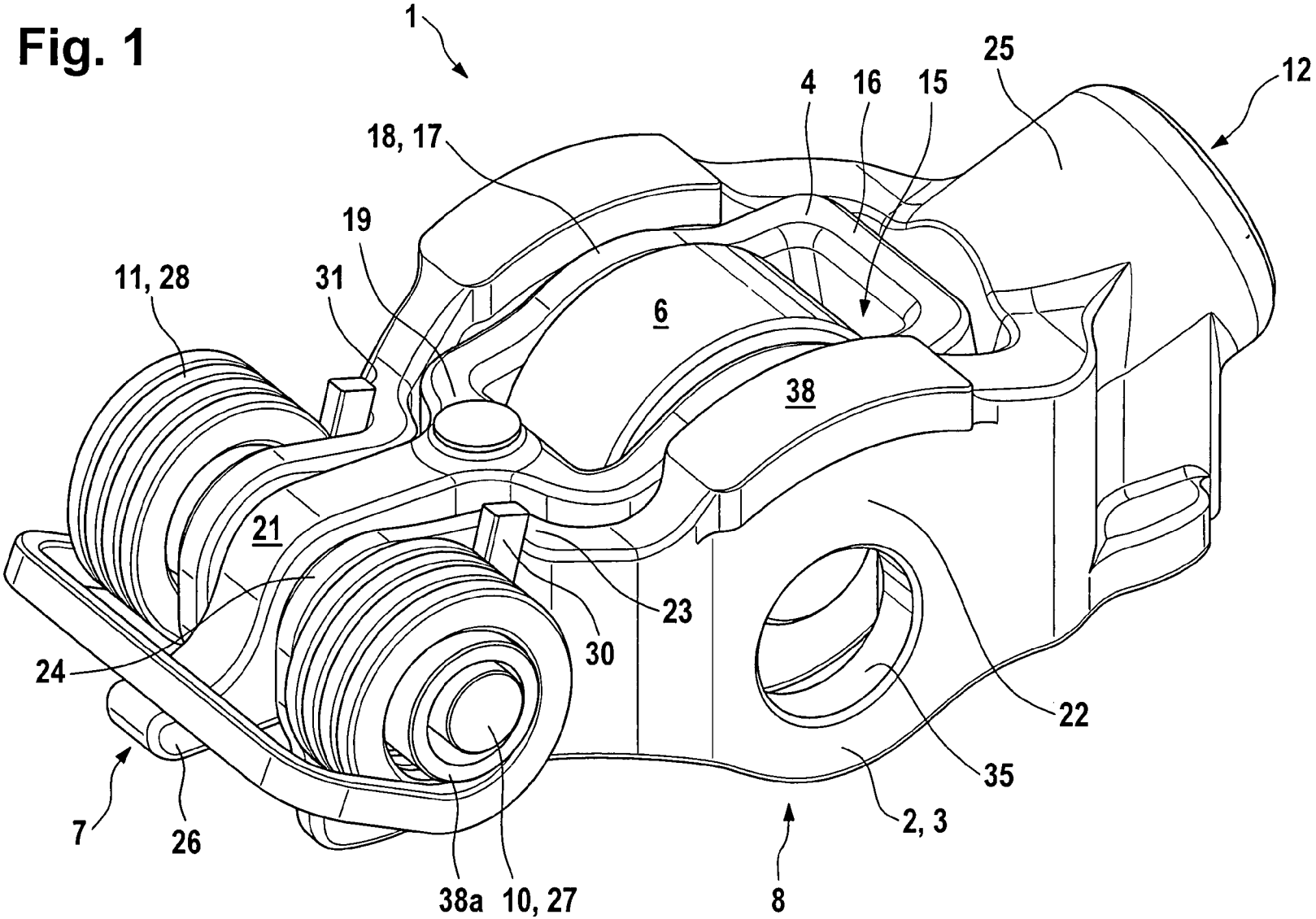
FIG. 1, a three-dimensional view of a switchable finger lever configured as a lift switch, FIG. 2, a top view of a switchable finger lever configured as a lift deactivator, and FIG. 3, a longitudinal section through the finger lever of FIG. 2.

But for slight differences in the region of the cam contacting surfaces, the figures show substantially identical finger levers 1.

The switchable finger lever 1 comprises an outer lever 2 having two arms 3, between which an inner lever 4 is arranged for relative pivoting thereto. In its center portion 17, the inner lever 4 comprises a roller 6 forming a contacting surface for a high-lift cam.

In the region of one end 7, both levers 2, 4 extend on a common axle 10. On the other end 12, the outer lever 2 comprises on an underside 8, a semi-spherical contact surface 13 for a support element. Through this surface, hydraulic medium can be routed to a front end of a coupling element 14, configured in the present case as a piston that is seated in a longitudinal bore 32 situated above the contact surface. As can be seen from the figure, the bore 32 extends longitudinally downwards as viewed in lever direction.

Figure 3:
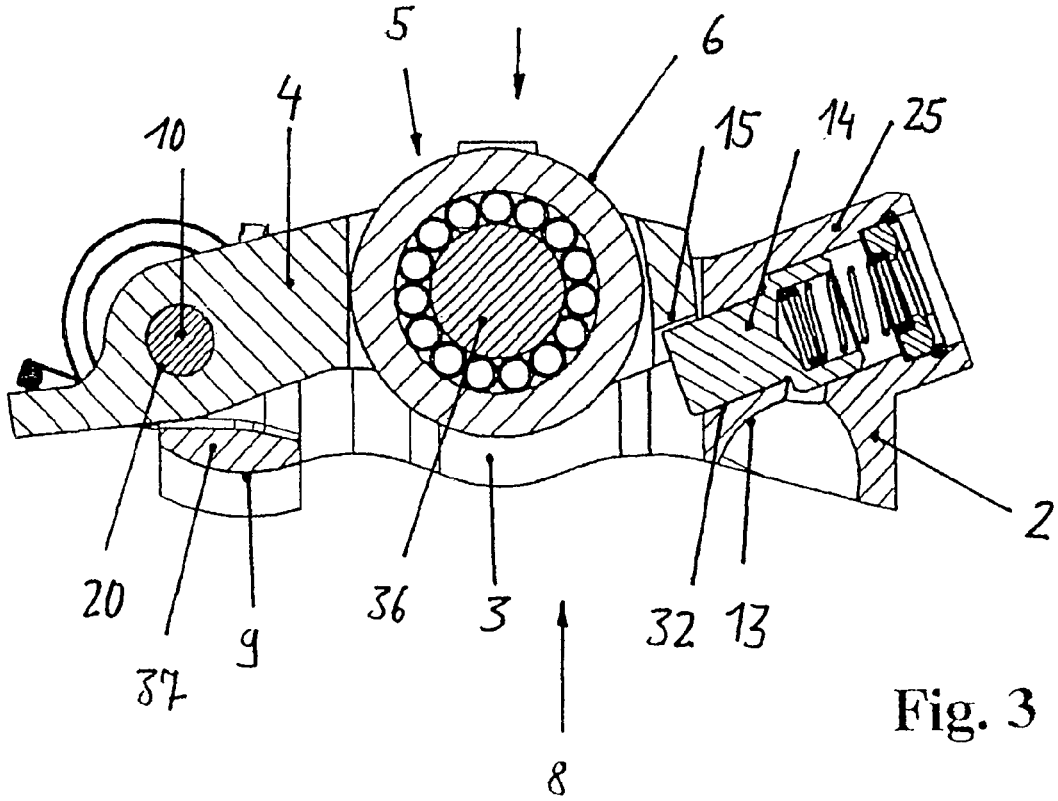

As illustrated in FIG. 3, the coupling element 14 engages under an entraining surface 15 of an end crossbar 16 of the inner lever 4. The entraining surface 15 is represented as an undersurface of the crossbar 16 but can also be a recess arranged therein.

Starting from the aforesaid crossbar 16 on the another end 12, the inner lever 4 has a box-like open center portion 17 that is laterally defined by two bar-shaped arms 18 between which the aforesaid roller forming a cam contacting surface 6 is received. In direction of the one end 7, the arms 18 merge into transversal bar sections 19 that are bent strongly toward each other and extend almost. perpendicular to a central longitudinal plane of the finger lever 1. In the direction of the one end 7, the transversal bar sections 19 merge together to form a single thin-walled bar 21 that extends with a finger-like extension 26 beyond the axle 10. The bar 21 is mounted through an eye 20 on the axle 10.

Figure 2:
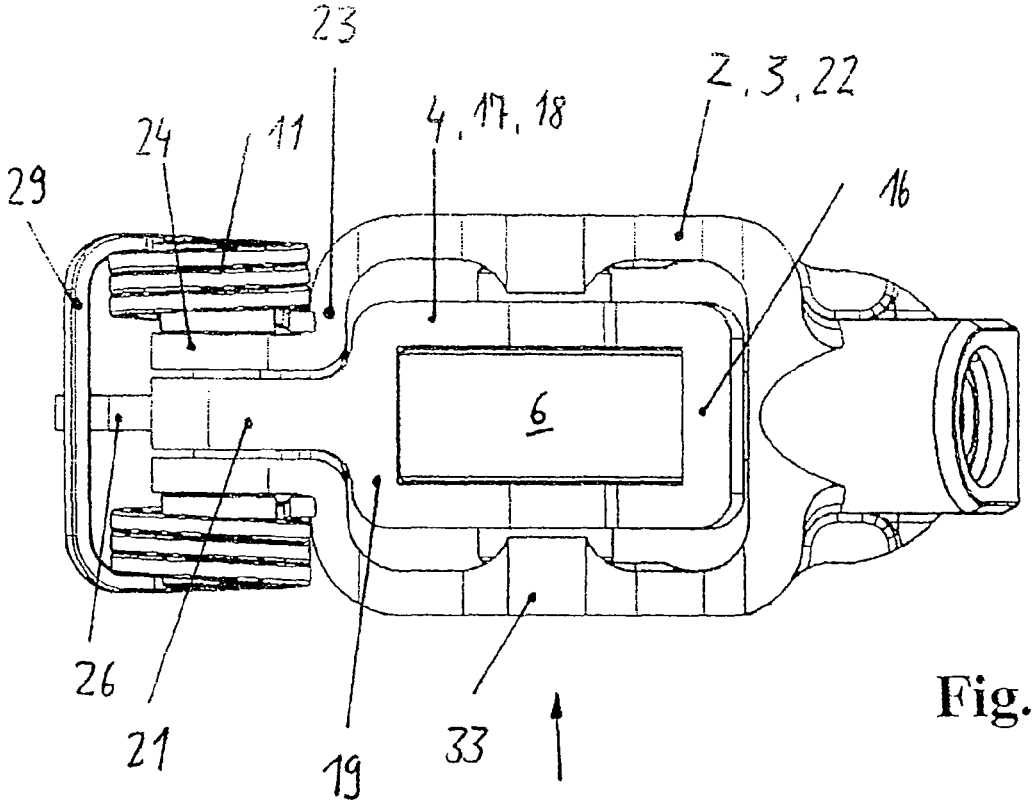

As further disclosed in FIGS. 1 and 2, in the region of the another end 12, the outer lever 2 comprises an end piece 25 that is formed in one piece with this and that comprises the bore 32 with the coupling element 14. In the direction of the one end 7, the outer lever 2 merges with a box-like center portion 22 whose arms 3, according to FIG. 1, comprise sliding surfaces 38 that constitute contact surfaces for low lift cams, and whose arms 3, according to FIGS. 2, 3, are configured only with support surfaces 33 (optional) for base circle cams or the like.

In the direction towards the one end 7, the center portion 22 of the outer lever 2 likewise merges into transversal portions 23 that, in the present embodiment, are also bent strongly toward each other while likewise extending perpendicular to the central longitudinal plane. The transversal portions 23 end in two parallel, slim fingers 24 that extend through bores on the axle 10.

In the region of its one, valve-side end 7, the finger lever 1 has an extremely narrow design width that, due to the reduced mass, has a favorable effect on the mass moment of inertia.

What must be emphasized is that the outer lever 2, starting from its arms 3 on the center portion 22 up to its fingers 24 on the end 7, is in osculating relationship with the inner lever 4. As a result, the "dead space" in this region is extremely small.

Only one torsion leg spring is provided as a lost motion spring means 11. For the mounting of this torsion leg spring, the axle 10 projects with a stub 27 on each side laterally out of the fingers 24 of the outer lever 2. Each stub 27 is surrounded with clearance by a separate bushing 38*a*. Thus, one winding region 28 of the torsion leg spring constituting the lost motion spring means 11 extends on each bushing 38*a*.

A leg 29 projects from each of the winding regions 28 of the lost motion spring means 11 on the axially outer side and is united into a bow shape with the other leg 29 to be supported on the lug-like extension 26. On the axially inner side, a further leg 30 projects from each of the winding regions 28 and is suspended on the outer side 31 of the bent transversal region 23 of the outer lever 2.

If necessary, coil springs or flat spiral springs are also imaginable and included in the scope of the invention as lost motion spring means 11.

As further disclosed in FIG. 1, each arm 3 of the outer lever 2 comprises a perforation 35, configured in the present case as a bore. Through this perforation 35, a pin 36 serving for the mounting of the cam contacting surface 6 configured in the form of a roller, can be mounted or dismounted as required (see introductory part of the description). A stop for the pin 36 in cam direction can be configured in the form of projections, not illustrated, on inner sides of the arms 3 of the outer lever 2.

It is additionally disclosed in FIG. 3 that the fingers 24 of the outer lever 2 are connected on the underside in the region of the one end 7 by a short crossbar 37. This results in the creation of a simple support 9 for at least one gas exchange valve, which support may also be laterally limited by protruding tabs.

The invention claimed is:

1. A switchable finger lever of a valve train of an internal combustion engine, said finger lever comprising an outer lever between whose arms an inner lever extends for pivoting relative to said arms, at least said inner lever possessing on an upper side, a cam contacting surface, a support for at least one gas exchange valve being arranged on an undersurface on one end of the finger lever, said inner and outer levers extending on a common axle in a region of said one end, said finger lever further comprising a lost motion spring means acting between said inner and outer levers, said outer lever possessing on the undersurface on another end, a contact surface for a support element, a longitudinally displaceable coupling element being arranged above or laterally of said contact surface, which coupling element, for realizing coupling, can be brought partially into engagement with an entraining surface of an adjoining crossbar of the inner lever, wherein the inner lever, starting from said crossbar on the another end, merges into a box-like open center portion having two bar-shaped arms that, in a direction toward the one end, comprise cross-bar sections that are strongly bent toward each other and extend further in form of a common, thin-walled bar comprising an eye that surrounds the axle in a central region of the axle, the outer lever comprises a box-like open center portion comprising said arms of the outer lever between which the center portion of the inner lever extends and that are likewise bar-shaped, these bar-shaped arms of the outer lever extend further in direction of the one end in form of transversal sections that are strongly bent toward each other and end in two parallel fingers while being arranged through bores on the axle, and the outer lever, at least starting from said arms in the center portion of the outer lever up to the fingers on the one end, adjoins the inner lever in a wall-against-wall engagement, the arms of the outer lever taper in direction of the another end to end in a solid end piece comprising the coupling element, said end piece being made as one of an integral part of the arms or a separate insert element, the bar of the inner lever on the one end continues beyond the axle into a lug-like extension that serves as a one-end support surface for the lost motion spring means.

2. The finger lever of claim 1, wherein, on front ends, the axle extends with a stub beyond respective ones of the fingers of the outer lever, the lost motion spring means is constituted by only one torsion leg spring, a region of whose winding surrounds each stub, a leg projects from each winding region on an axially outer side and merges into a bow shape to be supported on the lug-like extension, a further leg projects from each winding region on an axially inner side and acts on an outer side of the bent transversal section of the outer lever while being oriented approximately parallel to a transversal plane of the finger lever.

3. The finger lever of claim 1, wherein the coupling element is made as one of a piston or a piston assembly that is seated in bore that, as seen in a direction toward the one end, extends straightly or downwards inclined directly above the semi-spherical contact surface for the support element, and the coupling element can be displaced at least in one direction by hydraulic medium routed out of the contact surface.

4. The finger lever of claim 1, wherein the finger lever is configured as a lift deactivator, the cam contacting surface on the inner lever is configured as one of a roller mounted on a pin or as a sliding surface, and the arms of the outer lever are configured optionally as support surfaces for zero lift support cams or stops.

5. The finger lever of claim 1, wherein the finger lever is configured as a lift switch, the cam contacting surface on the inner lever is configured as one of a pin-mounted roller or a sliding surface for a contact of a high lift cam, and contacting surfaces on the arms of the outer lever are made as one of pin-mounted rollers or as sliding surfaces for a contact of low lift cams.

6. The finger lever of claim 1, wherein the arms of the outer lever comprise perforations.

7. The finger lever of claim 6, wherein the perforations possess a size and an arrangement such that mounting and dismounting of a pin serving for mounting a roller are, or can be, effected through these perforations if the cam contacting surface of the inner lever is configured as a roller.

8. The finger lever of claim 1, wherein the support for the gas exchange valve on the one end extends on a crossbar that connects the fingers of the outer lever on the undersurface.

9. The finger lever of claim 2, wherein each winding region of the lost motion spring means extends on a bushing that surrounds a respective one of the stubs with clearance.

* * * * *